US005647243A

United States Patent [19]

Zampini

[11] Patent Number: 5,647,243

[45] Date of Patent: Jul. 15, 1997

[54] DEVICE FOR HEMMING ELEMENTS OF PRESSED SHEET METAL

[75] Inventor: Antonio Zampini, Collegno, Italy

[73] Assignee: Comau S.p.A., Grugliasco, Italy

[21] Appl. No.: 595,207

[22] Filed: Feb. 1, 1996

[30] Foreign Application Priority Data

Feb. 2, 1995 [IT] Italy ..... T095A0061

[51] Int. Cl.[6] ..... B21D 5/01; B21J 9/18

[52] U.S. Cl. ..... 72/452.6; 72/312; 72/315

[58] Field of Search ..... 72/450, 452.6, 72/312, 315, 452.5

[56] References Cited

U.S. PATENT DOCUMENTS 2,726,702 12/1955 Laxo ..... 72/315

2,847,051 8/1958 Renard ..... 72/315

3,058,512 10/1962 Chebuhar et al. ..... 72/312

4,706,489 11/1987 Dacey, Jr. ..... 72/450

*Primary Examiner*—David Jones

*Attorney, Agent, or Firm*—Sughrue, Mion, Zinn, Macpeak & Seas

[57] ABSTRACT

An operation for hemming two sheet metal elements is carried out by two subsequent bending operations respectively carried out by two hemming tools which come in operation in sequence and are driven by cams mounted on a rotating driving shaft.

4 Claims, 6 Drawing Sheets

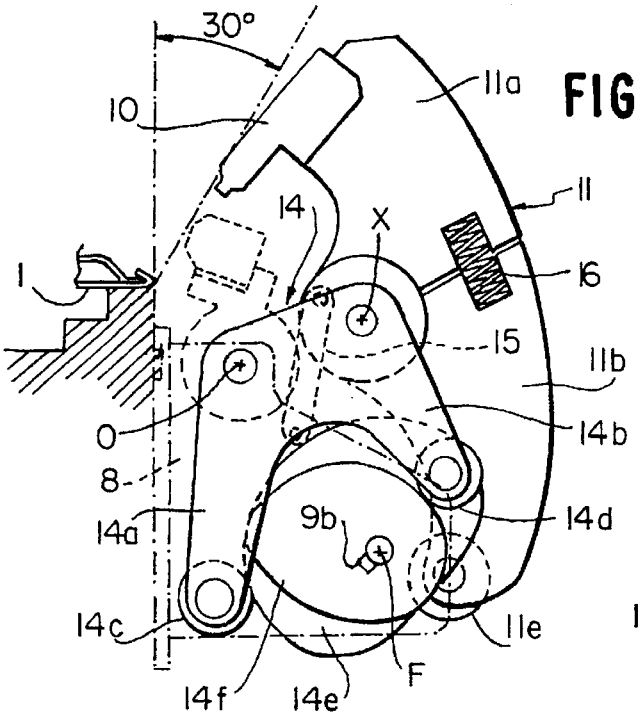
FIG.8
FIG.9
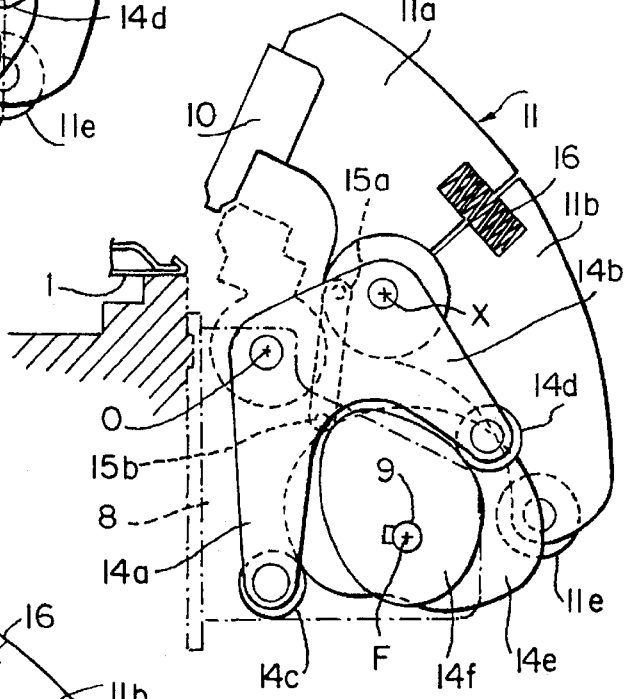
FIG.10
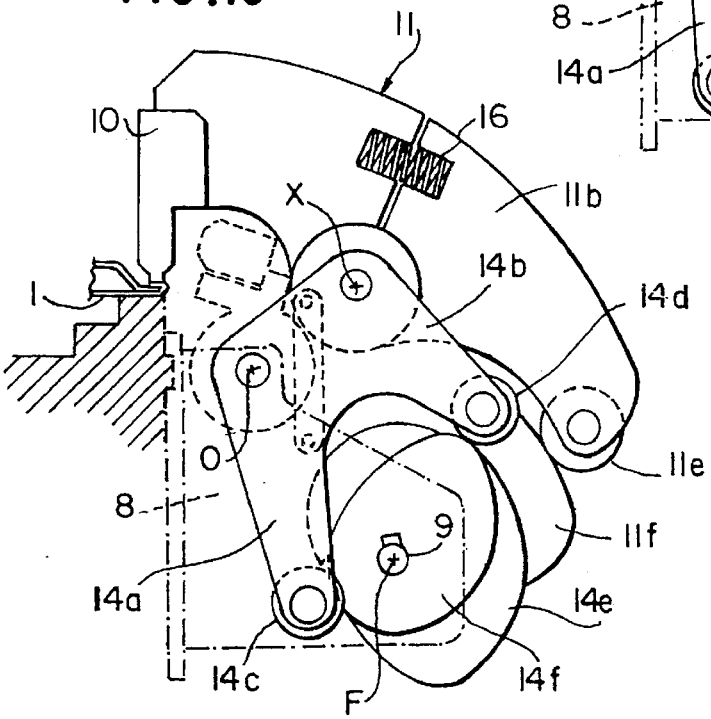

DEVICE FOR HEMMING ELEMENTS OF PRESSED SHEET METAL

BACKGROUND OF THE INVENTION

The present invention relates to devices for hemming elements of pressed sheet metal, for example motor vehicle body elements, of the known type comprising:

a fixed support structure, having a surface for supporting the sheet metal elements to be hemmed, a first hemming tool, for making a first bending of a peripheral edge of one of said sheet metal elements, said first hemming tool being rotatably supported by said fixed supporting structure around a first axis, and being movable between a rest position and a work position, a second hemming tool, for making a second bending of said peripheral edge following said first bending, in order to complete the hemming of said sheet metal elements, said second hemming tool being also supported by said fixed supporting structure so as to be movable between a rest position and a work position, and means for driving a cyclic movement of the first and second hemming tool between their rest positions and their work positions.

Devices of the above indicated type have been used for a long time in the automotive industry, for example for hemming the sheet metal elements forming doors, engine hoods or rear doors of motor vehicles.

According to the conventional technique, said means for driving the movement of the two hemming tools are comprised of hydraulic cylinders. Recently however, the need has been felt for some applications of avoiding the use of hydraulic devices, resorting to lever transmission devices driven by an electric motor. A device of this type is for example known from International patent application WO-9305902.

SUMMARY OF THE INVENTION

The object of the present invention is that of providing a hemming device which makes use of non hydraulic driving means and is simpler to manufacture and more efficient and reliable in operation than the devices provided heretofore.

In order to achieve this object, the invention provides a hemming device of the known type indicated at the beginning of the present invention, characterized in that said driving means includes:

a rotatable driving shaft rotatably mounted on said fixed support structure around a second axis which is parallel to and spaced apart from said first axis, first cam means mounted on said driving shaft and cooperating with first cam-following means associated with said first hemming tool, to drive the displacement of the first hemming tool from its rest position to its work position and then again to its rest position, in a first part of each round of rotation of the driving shaft, and to hold the first hemming tool in its rest position in a second part of each round of rotation of the driving shaft, second cam means mounted on said driving shaft, to drive displacement of said second hemming tool from its rest position to its work position and then again to its rest position, in said second part of each round of rotation of the driving shaft, and to hold the second hemming tool in its rest position in said first part of each round of rotation of the driving shaft, second cam-following means cooperating with said second cam means, an auxiliary supporting member carrying said second cam following means, which is rotatably mounted on said fixed support structure around said first axis, a supporting member for the second hemming tool, which is pivotable on said auxiliary supporting member around a third axis which is parallel to said first and second axes and said supporting member being also connected to the fixed support structure by means of a further articulated linkage member, third cam means carried by said driving shaft and cooperating with third cam following means carried by said supporting member of the second hemming tool, for further pushing the second hemming tool to its work position each time it is brought to said position by the second cam means.

Due to the above mentioned features, during each round of rotation of the driving shaft, at first the said first cam means comes in operation causing the displacement of the first hemming tool from its rest position to its work position, so as to make a first bending of the peripheral edge of one of the sheet metal elements to be hemmed. Typically, the two sheet metal elements to be hemmed are superimposed on a horizontal support surface of the fixed supporting structure. The underlying sheet metal element has a peripheral edge which is arranged substantially at 90° with respect to the support surface, off from the peripheral edge of the overlying element. The said first hemming tool makes a first bending, for example at about 45°, of the peripheral edge of the underlying sheet metal element.

With the continued rotation of the driving shaft, the first hemming tool returns to its rest position while the second hemming tool is brought to its work position in order to complete the hemming operation by bending said peripheral edge by a further angle of about 45°, so as to superimpose and press this edge above the peripheral edge of the other sheet metal element.

As indicated above, the second hemming tool is not rotatably mounted around the said first axis on which the first hemming tool is rotatably mounted. Indeed, the second hemming tool is carried by a supporting member which is pivotally connected to a further auxiliary supporting member. The latter on its turn is rotatably supported by the fixed structure around said first axis on which the first hemming tool is rotatably mounted. The above described particular mounting of the second hemming tool enables on one hand this tool to move properly in order to carry out the second bending of the peripheral edge of the sheet metal element and on the other hand avoids any interference between the two hemming tools during movement thereof, the second hemming tool being arranged in a rest position which is sufficiently spaced apart from the sheet metal elements to be hemmed, so as not to interfere with such elements when they are loaded or unloaded from their supporting surface.

Also according to what has been indicated above, said auxiliary supporting member to which the second hemming tool is rigidly connected is further provided with cam following means which cooperate with third cam means which are also carried by the driving rotating shaft in order to further press the second hemming tool into engagement onto said bent sheet metal edge immediately after that the tool has reached its work position because of said second cam means. It is thereby ensured that the second hemming tool exerts the necessary pressure to carry out a proper hemming of the sheet metal elements.

According to a further feature of the invention, in order to allow for the further movement of the said second hemming tool due to said third cam means, said further articulated linkage member which connects the second auxiliary supporting member to the fixed supporting structure is comprised of a member which yields elastically above a predetermined compression load.

In a preferred embodiment of the invention, both the said first cam means which drive the first hemming tool, and the said second cam means which drive the second hemming tool are comprised of a pair of cooperating cams carried by the rotatable driving shaft, which cooperate with respective cam following rollers carried by a structure rigidly connected to the first hemming tool and the said first auxiliary supporting member, respectively.

Said cooperating cams are designed so as to ensure that at each angular position of the driving shaft there corresponds a single position, with no play, of the first hemming tool and the said auxiliary supporting member on which the second hemming tool is pivotally mounted, respectively.

According to a further preferred feature, said supporting member for the second hemming tool is comprised of two separate elements having spring means interposed therebetween which is able to yield above a predetermined load, so as to ensure the proper operation of the device even if the thickness of the sheet metal elements to be hemmed are slightly greater than those on design.

Yet in said preferred embodiment, said third cam means which cause the final pushing action onto the second hemming tool are comprised of two cams which are identical to each other, and are mounted on the rotating driving shaft and cooperate with respective cam following rollers carried by two respective arms forming part of the supporting member for the second hemming tool.

BRIEF DESCRIPTION OF THE DRAWINGS

Further features and advantages of the invention will become apparent from the description which follows with reference to the annexed drawings, given purely by way of non limiting example, in which.

DETAILED DESCRIPTION OF THE INVENTION

Figure 1:
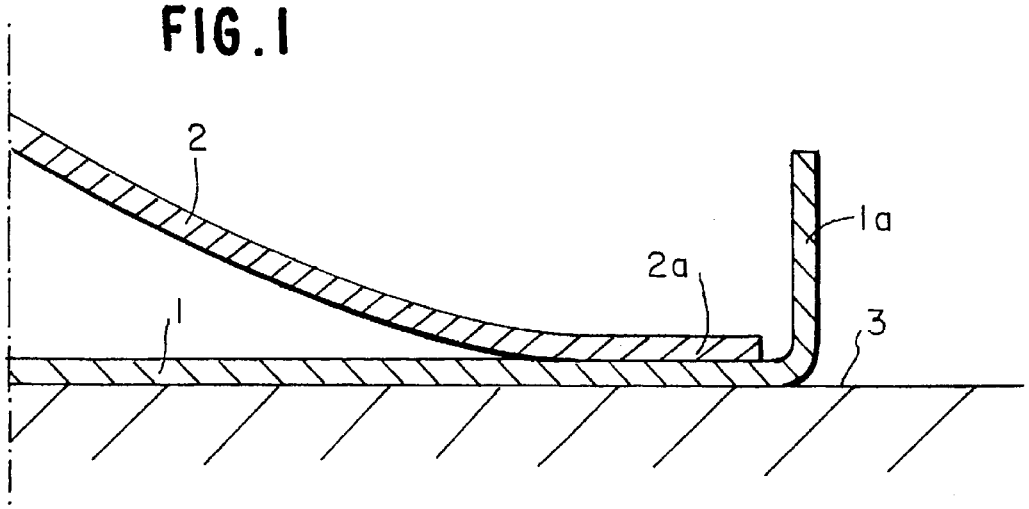
FIGS. 1, 2 and 3 are cross-sectional views which show the hemming operation which is provided by the device according to the invention.
Figure 2:
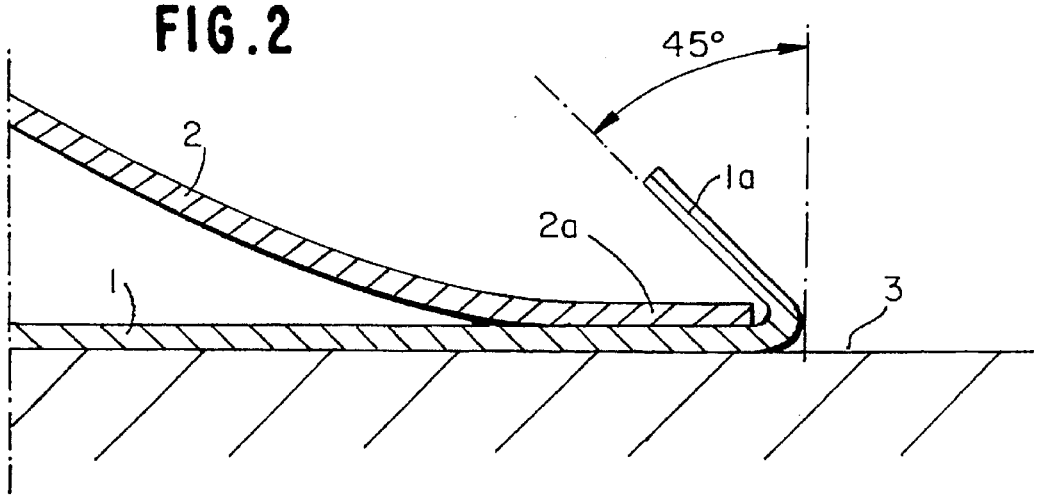
Figure 3:
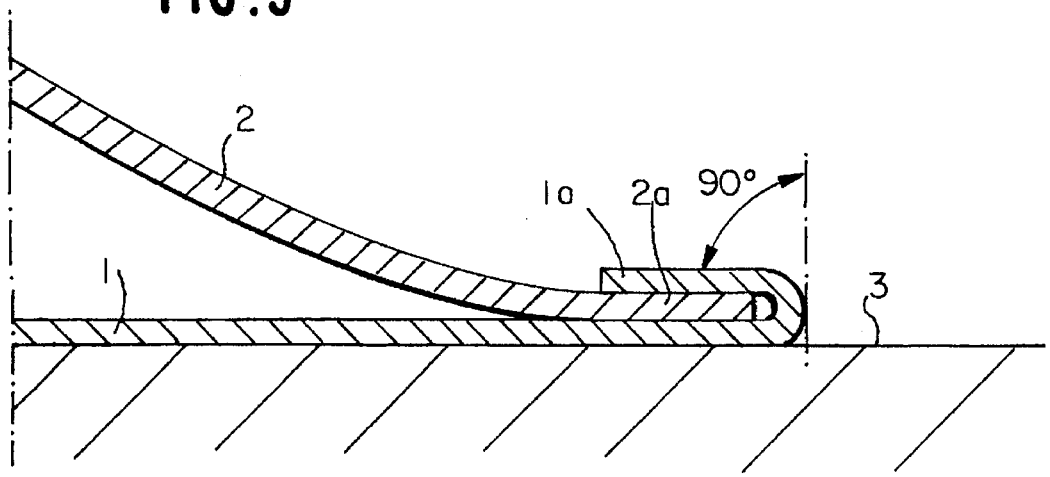

FIGS. 1, 3 show the peripheral part of two elements of pressed sheet metal 1, 2 respectively constituting the outer panel and the inner panel of a motor vehicle door. In order to provide for the hemming of these panels, there is provided a fixed supporting structure having a horizontal supporting surface 3 on which the panels are positioned. Prior to the hemming operation, the underlying panel 1 has a peripheral edge 1*a* arranged substantially at 90° with respect to the supporting surface 3 and off of the peripheral edge 2*a* of the overlying panel 2. By the device according to the invention it is possible to make at first, by a first hemming tool, a bending of about 45° (FIG. 2) of the peripheral edge 1*a* and at a second time a further bending so as to arrange the peripheral edge 1*a* at about 90° with respect to its initial position so that it is superimposed and pressed against the peripheral edge 2*a*. According to a technique known per se, many devices according to the invention are provided along the periphery of the two panels 1, 2 in order to provide for the hemming of the two panels throughout their periphery.

Referring now to FIGS. 4–10 and 12, the device according to the invention, generally designated by reference numeral 4, comprises a first hemming tool 5 formed by a metal elongated body fixed by screws to a support 6 which is rigidly connected to a cylindrical body 7 forming a supporting member for the first hemming tool 5. The supporting member 7 of the first hemming tool 5 is rotatably supported around a first axis O by the fixed structure of the device, designated by reference numeral 8.

As shown in FIGS. 4–10 and 12, the supporting member 7 for the first hemming tool 5 incorporates two arms 7*a*, 7*b* which radially project from the cylindrical body of member 7 and each having a fork-shaped end carrying a cam-following roller, respectively designated by 7*c* and 7*d*. The two cam following rollers 7*c*, 7*d* respectively cooperate with two cams 7*e*, 7*f* which are connected to a rotatable driving shaft whose axis, designated by F, is parallel and spaced apart from axis O on which the first hemming tool 5 is rotatably mounted. The driving shaft 9 is to be driven by an electric motor (not shown) so as to complete one round at constant speed each time that it is necessary to carry out a hemming cycle.

The operation of the above described portion of the device according to the invention will be now described.

Figure 6:
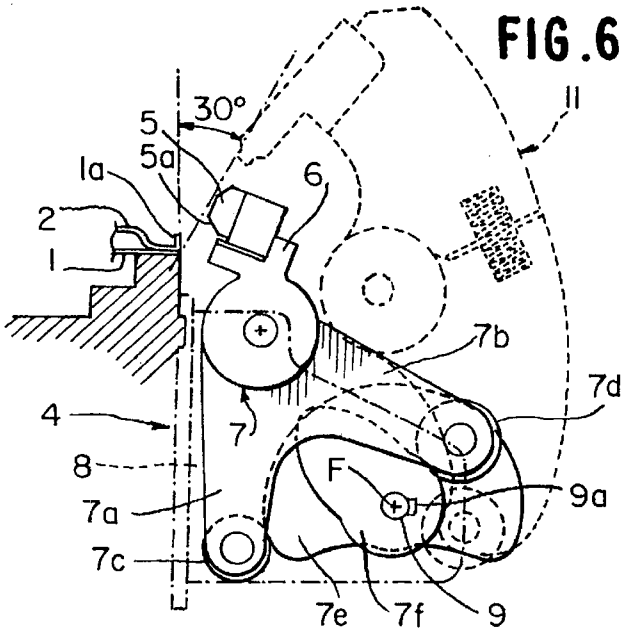

The hemming tool 5 is movable between a rest position (shown in FIG. 6) and a work position (shown in FIG. 7) by a rotation of the supporting member 7 around axis O. This rotation is driven by cams 7*e*, 7*f* following a rotation of the rotating driving shaft 9. As shown in FIG. 6, in its rest position the first hemming tool 5 is laterally spaced apart with respect to the position of the edge 1*a* to be bent so as to lie outside of a plane inclined by 30° with respect to the vertical direction passing through the corner of the peripheral edge 1*a*. This condition ensures that the sheet metal elements 1, 2 may be loaded and unloaded from the supporting surface 3 with no interference with the hemming tool.

Figure 7:
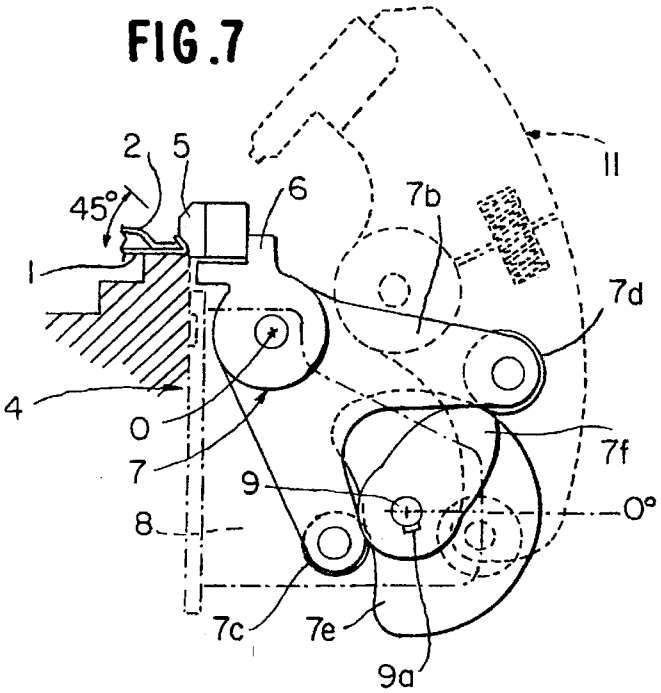

Starting from the position illustrated in FIG. 6, a clockwise rotation (with reference to this figure) of the driving shaft 9 causes a corresponding rotation of cams 7*e*, 7*f*. Cam 7*f* in particular, by pushing the cam following rollers 7*d*, causes an anti-clockwise rotation (again with reference to FIG. 6) of the supporting member 7 of the hemming tool 5 until this tool is brought to its work position shown in FIG. 7, in which it causes the first bending at 45° of the peripheral edge 1*a*. Again with reference to FIG. 7, it is to be noted that the hemming tool 5 has a surface 5*a* inclined by about 45° with respect to its front surface which comes into engagement with the peripheral edge 1*a* causing bending thereof by 45° (see FIG. 7). In FIGS. 2, 7 there is diagrammatically shown a key 9*a* used for connecting cams 7*e*, 7*f* to the driving shaft 9. In these figures, key 9*a* may be taken as a reference of the angular position of the cams. Therefore, by measuring the angle of rotation of the driving shaft 9 starting from the position of key 9*a* in FIG. 6, in this figure, the angle of rotation amounts to 0°. As shown in FIG. 7, the work position of the first hemming tool 5 is reached after a rotation of 75° of the driving shaft.

Naturally, the angular values indicated in the present description with reference to the annexed drawings merely refer to a preferred embodiment of the invention. Obviously, however the invention may be provided also in a different way from what is illustrated herein by way of example.

The two cams 7*e*, 7*f* cooperate with each other, in a sense that while cam 7*f* fulfils the function of pushing the hemming tool 5 to bring it from the rest position to the work position, cam 7*e* keeps in contact with the cam following roller 7*c* so as to ensure that at each angular position of the driving shaft 9 there corresponds a single position of the support 7, with no play which might be detrimental for the precision of the hemming operation. Similarly, with the continued rotation of the driving shaft 9 beyond the 75° angle (FIG. 7), cam 7*e* begins to fulfil a pushing action onto the cam following roller 7*c* in order to return the support member 7 to the rest position shown in FIG. 6, while cam 7*f* keeps in contact with the cam following roller 7*d* to prevent any play. The rest position of the hemming tool 5 is again reached after a further rotation of 75° of the driving shaft 9. In the remaining portion of the round of rotation of the driving shaft 9, the cam following rollers 7*c* and 7*d* are in contact with constant radius portions of cams 7*e*, 7*f* so that during this stage the hemming tool 5 is kept in its rest position.

Figure 11:
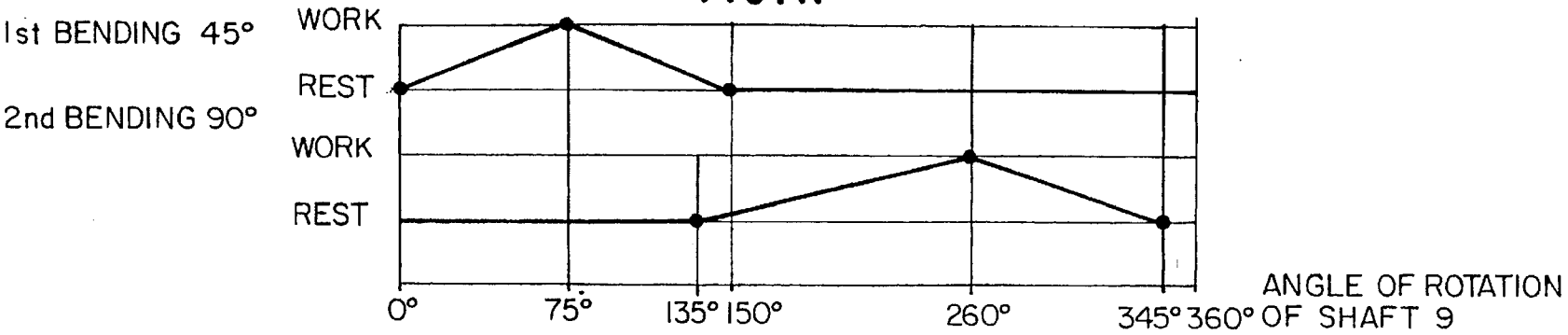
FIG. 11 shows a diagram which shows the cycle of operation of the device according to the invention.

The above described cycle of operation is also shown in the upper part of the diagram of FIG. 11 which shows the making of the first bending at 45° by the displacement of the first hemming tool 5 from its rest position to its work position and vice versa, during the rotation of the driving shaft 9.

As shown, the hemming tool 5 is at a rest position at a rotational angle of 0°, it reaches the work position at 75° and returns to its rest position at 150°, and remains in this position until the 360° of rotation are completed.

In the following there will be now described the structure of the device relating to the making of the second bending of the peripheral edge of sheet metal (FIG. 3).

With reference again to FIG. 4 and FIGS. 8–10, the device comprises a second hemming tool 10 formed by an elongated metal body fixed by screws (not shown) to two parallel and spaced apart brackets 11*a* forming part of a supporting member for the second hemming tool 10, which is generally designated by 11. The two brackets 11*a* are connected to each other by a cross-member 11*c*.

The brackets 11*a* of the supporting member 11 of the second hemming tool 10 are rotatably mounted around an axis X on a pin 12 carried by a cylindrical body 13 forming part of an auxiliary supporting member generally designated by 14. The auxiliary supporting member 14 is on its turn rotatably supported around the axis O by the fixed supporting structure of the device and comprises two arms 14*a*, 14*b* extending radially from the axis O and each having one fork-shaped end carrying a cam following roller respectively designated by reference numeral 14*c* and 14*d*. The cam following rollers 14*c*, 14*d* cooperate with two cooperating cams 4*e* and 14*f* which are connected, by a key 9*b*—see FIG. 8—to the driving shaft 9.

Therefore, with reference to FIGS. 8–10, the auxiliary supporting member 14 is rotatably mounted on the fixed supporting structure of the device around axis O, whereas the supporting member 11 of the second hemming tool 10 is connected to the auxiliary supporting member 14 by the articulation around axis X, as well as by a further articulated linkage formed by a connecting rod 15 having one end articulated at 15*a* to the supporting member 11, and the other end articulated at 15*b* to the fixed structure of the device.

Figure 4:
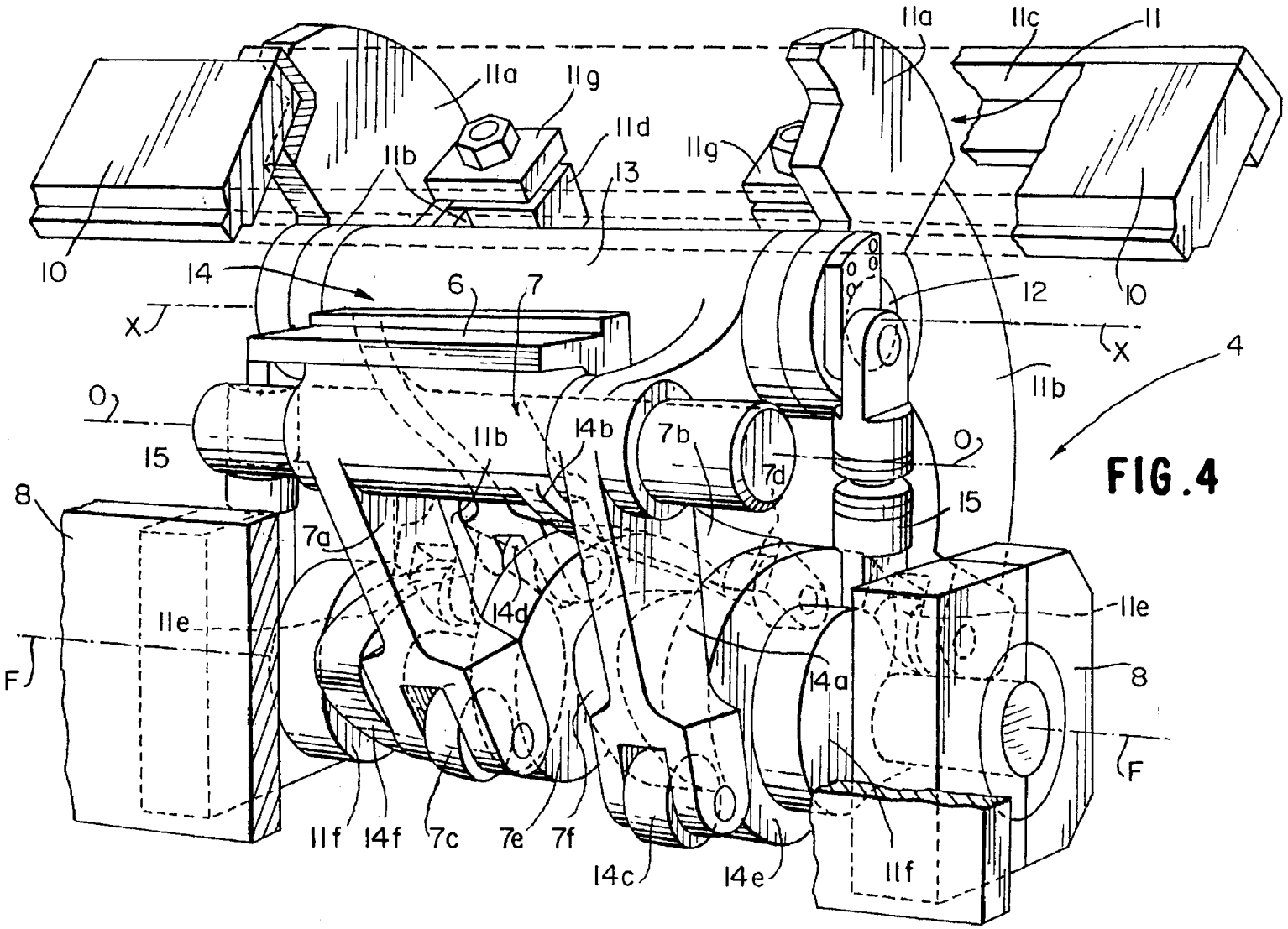
FIG. 4 shows a perspective diagrammatic view of a preferred embodiment of the device according to the invention.
Figure 5:
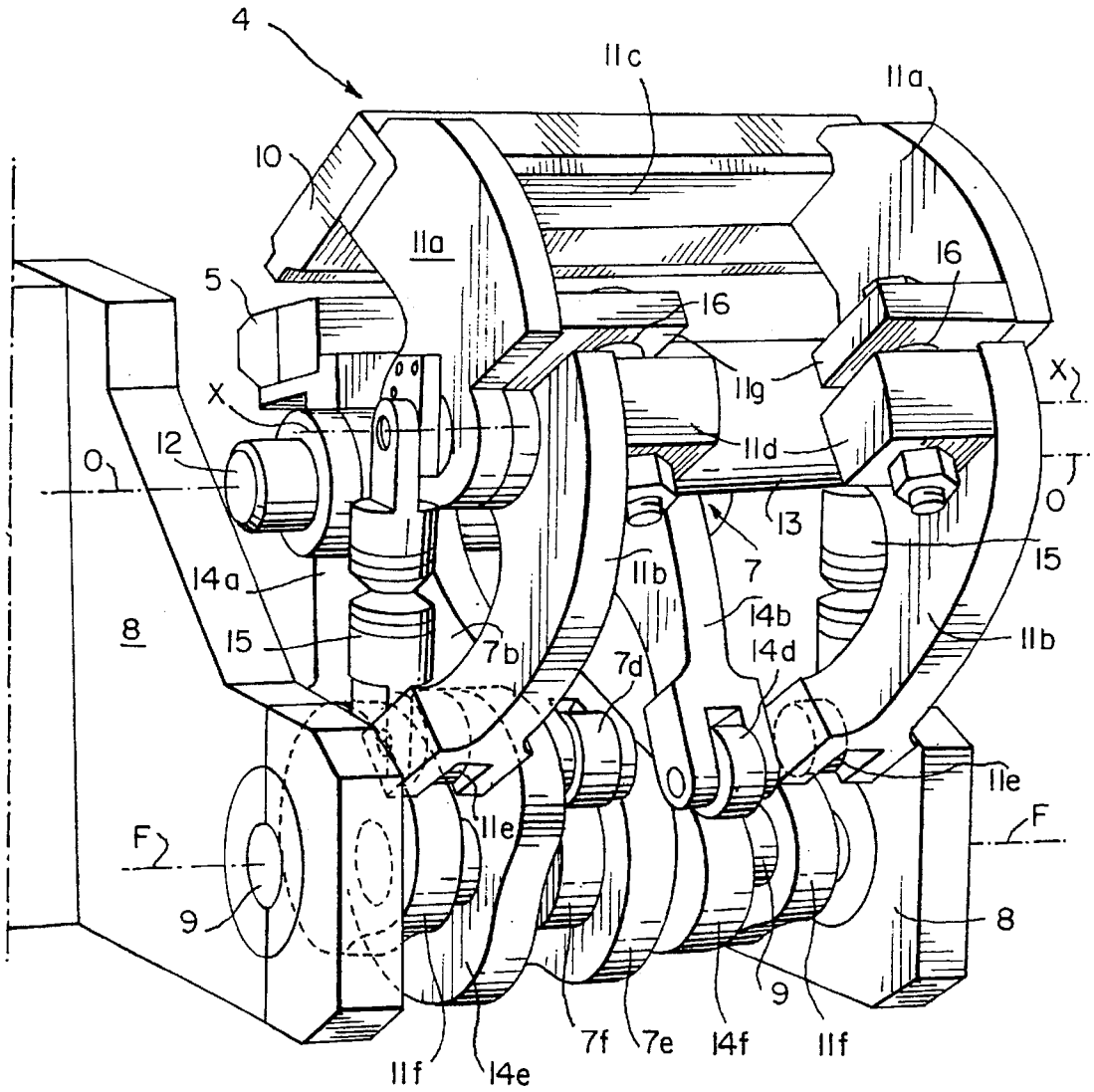
FIG. 5 shows a further perspective view of the device of FIG. 4, FIGS. 6–10 are diagrammatic side views of the device of FIGS. 4, 5 which show the various stages of its operation.
Figure 12:
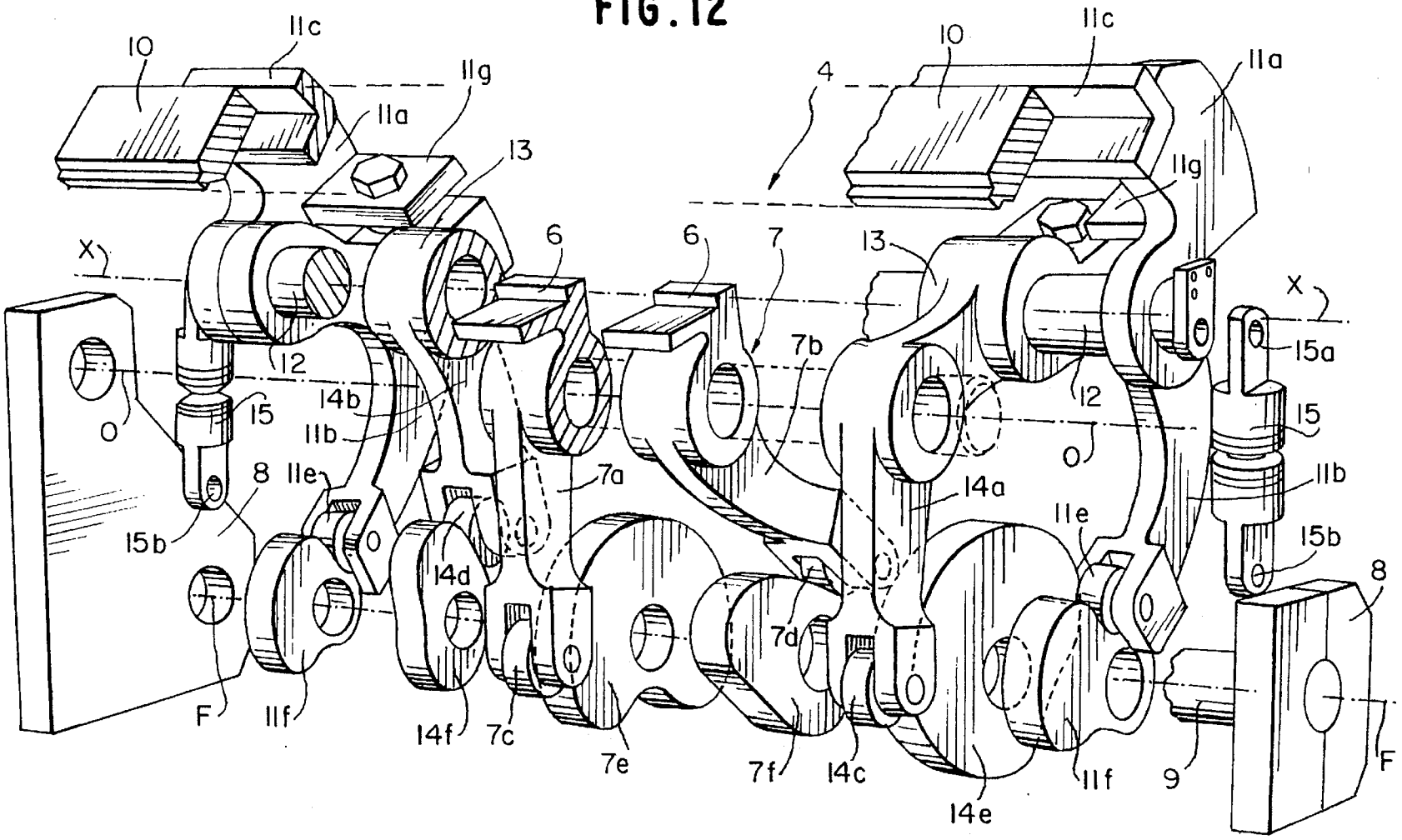
FIG. 12 is an exploded perspective view of the device of FIG. 4.

With reference to FIGS. 4, 5 and 12, the supporting member 11 of the hemming tool 10 further includes two arms 11*b* parallel to and spaced apart from each other, each provided with a projecting element 11*d* and rotatably mounted around a pin 12 of the auxiliary supporting member 14. As already indicated, the two brackets 11*a* and the two arms 11*b* form a single supporting structure of the second hemming tool 10.

The two arms 11*b* have fork-shaped ends carrying cam following rollers 11*e* which cooperate with two identical cams 11*f* (only one of which is visible in FIG. 10) whose function will be clarified in the following. Between elements 11*d* and two brackets 11*g* fixed to the brackets 11*a* (FIG. 5) there are interposed spring units 16 which allow the cross member 11*c* and the elements 11*d* to move closer when they are subject to a load greater than a predetermined value.

Also the articulated linkage member 15 is elastically yieldable so as to become shorter when it undergoes to a compression force greater than a determined threshold value.

The operation of the above described part of the device according to the invention will be now described.

With reference also to the lower part of the diagram shown in FIG. 11, the second hemming tool 10 which is to carry out the second bending of the peripheral edge of sheet metal remains in its rest position shown in FIG. 8 during the whole work stage of the first hemming tool 5. At a rotational angle of 135° of the driving shaft 9, when the first hemming tool is almost returned to its rest position, cam 14*f* begins to push against the cam following roller 14*d* so as to rotate the auxiliary supporting member 14 in an anti-clockwise direction (with reference to FIG. 8) around axis O. During this rotation, cam 14*e* keeps in contact with the cam following roller 14*c* so as to avoid any play of the auxiliary supporting member 14, which thus is at a determined angular position for each angular position of the driving shaft 9. The anti-clockwise rotation of the auxiliary supporting member 14 causes a corresponding movement of the supporting member 11 of the second hemming tool 10 which brings the hemming tool 10 from its rest position shown in FIG. 8 to its work position shown in FIG. 10. This movement is carried out, as already indicated, as a result of the anti-clockwise rotation of the auxiliary supporting member 14 and because of the articulated linkage existing between the supporting member 11 of the second hemming tool 10 and the auxiliary supporting member 14 (constituted by the articulation around axis X and the articulated linkage member 15). The above described transmission is such that the hemming tool 10 is brought with its front engaging surface onto the peripheral edge 1*a* of sheet metal, so as to press the latter in the condition bent by 90° shown in FIG. 3. This is done starting from a rest position of the hemming tool 10 in which this tool is arranged off a plane inclined by 30° with respect to the vertical direction and passing through the corner of the bent edge 1*a*. This condition ensures that the sheet metal elements may be loaded and unloaded properly with no interference with the hemming tool 10. At the same time, the above described transmission avoids any interference of the hemming tool 10 with the hemming tool 5 during the above described movement. FIG. 9 shows the intermediate position of the hemming tool 10, during its movement from the rest position to the work position, in which it is closer to the hemming tool 5 which, as discussed, during this stage is in its rest position.

Again with reference to the lower diagram of FIG. 11, the work position of the second hemming tool 10 is reached at a rotational angle of 260° of the driving shaft 9, whereupon the further rotation of the shaft causes the hemming tool 10 to be returned to its rest position, because of the pushing action which during this stage is exerted by cam 14*e*, with cam 14*f* which keeps in contact with the respective cam following roller 14*d* to prevent any play of the auxiliary supporting member 14.

It is to be noted, again with reference to the diagram of FIG. 11, that the hemming tool 10 returns to its rest position at a rotational angle of 345° of the driving shaft 9, i.e. 15° before the end of a complete round of rotation. This condition is desired to ensure the proper operation of the device even when the control system of the driving electric motor is not able to ensure an absolute precision of the position of the driving shaft when the electric motor is stopped after a complete round of rotation.

Again with reference to FIG. 10, as soon as the hemming tool 10 has reached its work position in which it provides the bending by 90° of the peripheral edge 1*a* of sheet metal, the two cams 11*f* come in operation exerting on the respective cam following rollers 11*e* a pushing action which causes a further compression of the hemming tool above the bent sheet metal edge, so as to ensure that the hemming operation is carried out perfectly. The profile of cams 11*f*, which are identical to each other, is chosen so as to exert this pushing action only through a short portion of the angular movement of the driving shaft, exactly when the work position of the hemming tool 10 is reached. The further movement of the supporting member 11 of the hemming tool 10 caused by cams 11*f* is allowed by the articulated linkage member 15 which during this stage becomes shorter, as a result of the yielding of its spring means. Furthermore, any overstress of the supporting structure 11 determined for example by that the thickness of the bent sheet metal edges are slightly greater, due to the tolerances of manufacture; than those on design, are absorbed by the spring units 16 which during this stage allow cross members 11*c*, 11*d* to move closer and hence a relative rotation of arms 11*b* with respect to brackets 11*a*.

Due the above described features, the device according to the invention is therefore able to ensure that the hemming operation is carried out properly. The whole structure of the device is relatively simple to manufacture and reliable in operation. The above described particular transmission used for supporting the hemming tool 10 which carries out the second bending ensures that both the hemming tools have rest positions which are sufficiently spaced apart from the work position to allow proper loading and unloading of the parts to be hemmed with no interference with the tools. At the same time, the hemming tools are able to operate properly without interfering with each other. Finally, the whole device is controlled by a self breaking asynchronous three phase electric motor, in lieu of the hydraulic control devices used in the conventional devices.

Naturally, while the principle of the invention remains the same; the details of construction and the embodiments may widely vary with respect to what has been described and illustrated purely by way of example, without departing from the scope of the present invention.

What is claimed is:

1. Device for hemming elements of pressed sheet metal, comprising:

a fixed supporting structure, having a surface for supporting the sheet metal elements to be hemmed, a first hemming took, to carry out a first bending of a peripheral edge of one of said sheet metal elements, said first hemming tool being rotatably supported by said fixed supporting structure around a first axis, and being movable between a rest position and a work position, a second hemming tool, to carry out a second bending of said peripheral edge following said first bending, in order to complete the hemming of said sheet metal elements, said second hemming tool being also supported by said fixed supporting structure so as to be movable between a rest position and a work position, and means for driving a cyclic movement of the first and second hemming tools between respective rest positions and respective work positions, wherein said control means includes:

a rotating driving shaft rotatably mounted on said fixed supporting structure around a second axis which is parallel to and spaced apart from said first axis, first cam means mounted on said driving shaft and cooperating with first cam-following means associated with said first hemming took, to drive the movement of the first hemming tool from said rest position to said work position and then again to said rest position during a first part of each round of rotation of the driving shaft, and to keep the first hemming tool in said rest position during a second part of each round of rotation of the driving shaft, second cam means mounted on said driving shaft, to drive the movement of said second hemming tool from said rest position to said work position and then again to said rest position, during said second part of each round of rotation of the driving shaft, and to keep the second hemming tool in said rest position during said first part of each round of rotation of the driving shaft, second cam-following means cooperating with said second cam means, an auxiliary supporting member carrying said cam-following means, rotatably mounted on said fixed supporting structure around said first axis, a supporting member of the second hemming tool, pivotally mounted on said auxiliary supporting member around a third axis parallel to said first and second axes and being further connected to the fixed supporting structure by a further articulated linkage member, third cam means carried by said driving shaft and cooperating with third cam-following means carried by said supporting member of the second hemming tool, to further push the second hemming tool to said work position each time that it is brought to said work position by said second cam means.

2. Device according to claim 1, wherein said further articulated linkage member is comprised of a connecting rod which is elastically yieldable under a compression load greater than a predetermined value.

3. Device according to claim 1, wherein said supporting member of the second hemming tool comprises two portions separate from each other connected to each other with the interposition of supports which are elastically yieldable over a predetermined compression load.

4. Device according to claim 1, wherein said first cam means and said second cam means each comprise a pair of cams cooperating which each other respectively cooperating with two cam following rollers so as to define a single angular position of the member carrying said cam following rollers for each angular position of the driving shaft.

* * * * *